United States Patent [19]

Budzich

[11] 4,333,389

[45] Jun. 8, 1982

[54] LOAD RESPONSIVE FLUID CONTROL VALVE

[76] Inventor: Tadeusz Budzich, 80 Murwood Dr., Moreland Hills, Ohio 44022

[21] Appl. No.: 119,382

[22] Filed: Feb. 7, 1980

Related U.S. Application Data

[63] Continuation-in-part of Ser. No. 113,288, Jan. 18, 1980.

[51] Int. Cl.[3] ..... F15B 13/04

[52] U.S. Cl. ..... 91/446; 137/596.1

[58] Field of Search ..... 91/446; 137/596, 596.13, 137/596.1

[56] References Cited

U.S. PATENT DOCUMENTS 3,744,517 7/1973 Budzich ..... 137/596.1 X 4,282,898 8/1981 Harmon et al. ..... 137/596.13

*Primary Examiner*—Gerald A. Michalsky

[57] ABSTRACT

A direction flow control valve for control of negative load equipped with a pilot operated load responsive negative load control, which automatically regulates valve outlet pressure to maintain a relatively constant pressure differential between negative load pressure and valve outlet pressure and which permits variation in the level of pressure differential in response to an external control signal, while this pressure differential is maintained constant at each controlled level.

43 Claims, 9 Drawing Figures

$$P_W - P_1 = \Delta P_y$$
$$P_1 - P_2 = \Delta P_x$$
$$P_W - P_2 = \Delta P$$
$$\therefore \Delta P_y = \Delta P - \Delta P_x$$

LOAD RESPONSIVE FLUID CONTROL VALVE

This is a continuation in part of application Ser. No. 113,288, filed Jan. 18, 1980, for "Load Responsive Fluid Control Valve."

BACKGROUND OF THE INVENTION

This invention relates generally to load responsive fluid control valves and to fluid power systems incorporating such valves, which systems are supplied with energy from negative system loads.

In more particular aspects this invention relates to load responsive direction and flow control valves capable of proportional control of negative loads, which maintain a constant pressure differential between negative load pressure and valve outlet pressure.

In still more particular aspects this invention relates to pilot operated load responsive controls of direction control valves, which permit variation in the level of control differential between negative load pressure and valve outlet pressure, while this control differential is automatically maintained constant at each controlled level.

Closed center load responsive direction and flow control valves, capable of proportional control of velocity of negative loads, independent of the load pressure, are very desirable. Such valves, by fluid throttling action, automatically maintain a constant pressure differential between negative load pressure and valve outlet pressure. A variable orifice, introduced between the negative load and valve outlet, varies the flow supplied from negative load, each orifice area corresponding to a different flow level, which is maintained constant irrespective of variation in the magnitude of negative load. Such load responsive direction control valves, for control of negative loads, are disclosed in my U.S. Pat. No. 3,744,517 dated July 10, 1973 and my U.S. Pat. No. 3,882,896 dated May 13, 1975. However, while those valves are effective in proportionally controlling negative loads, they provide a constant pressure differential and therefore a constant throttling action across each valve. Such constant pressure differential is predetermined during construction of the valve control and therefore can not be varied during control of negative load. Also those valves use an unamplified load pressure signal, in operation of their controllers, requiring a control signal at a comparatively large energy level.

SUMMARY OF THE INVENTION

It is therefore a principal object of this invention to provide improved pilot operated load responsive direction control valve for control of negative load, which permits variation in the level of control differential between negative load pressure and valve outlet pressure, while this control differential is automatically maintained constant at each controlled level.

Another object of this invention is to provide pilot operated load responsive controls of a direction control valve, through which control of negative load can be either accomplished by variation in area of the orifice, between the fluid motor and valve outlet, while the pressure differential across this orifice is maintained constant at a specific level, or by control of pressure differential, acting across this orifice, while the area of the orifice remains constant.

It is a further object of this invention to provide pilot operated load responsive controls of a direction control valve, which permit variation in the controlled pressure differential across a metering orifice in response to an external control signal.

It is a further object of this invention to provide pilot operated load responsive controls of a direction control valve, in which an external control signal, at a minimum force level, can adjust and control the pressure differential, acting across a metering orifice of a load responsive direction control valve controlling a negative load, while the negative load is being controlled by variation in area of the metering orifice.

It is a further object of this invention to provide load responsive controls of direction control valve, which modify control signals, supplied to the pilot operated valve controls, to control the pressure differential across an orifice of a load responsive direction control valve controlling a negative load.

It is a further object of this invention to provide load responsive controls of direction control valve, which modify control signals supplied at minimum energy level to the amplifying stage of the valve controls, to control pressure differential across an orifice of a load responsive direction control valve.

Briefly the foregoing and other additional objects and advantages of this invention are accomplished by providing novel load responsive control of a direction control valve, to throttle fluid supplied from negative load either in response to one control input, namely variation in the area of metering orifice, to control a constant pressure differential, at a preselected level between negative load pressure and valve outlet pressure, or in response to another control input, namely modification in the pressure of control signal, to vary the level of the control differential between negative load pressure and the valve outlet pressure, while this control differential is automatically maintained constant at each controlled level by valve controls receiving low energy control signals to their amplifying stage. In this way a load can be controlled in response to either input providing identical control performance, or the variable pressure differential control can be superimposed on the control action controlling a negative load by variation in the area of the metering orifice. Therefore this control system lends itself very well to an application, in which a manual control input from an operator may be modified by an electronic logic circuit, or a microprocessor.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
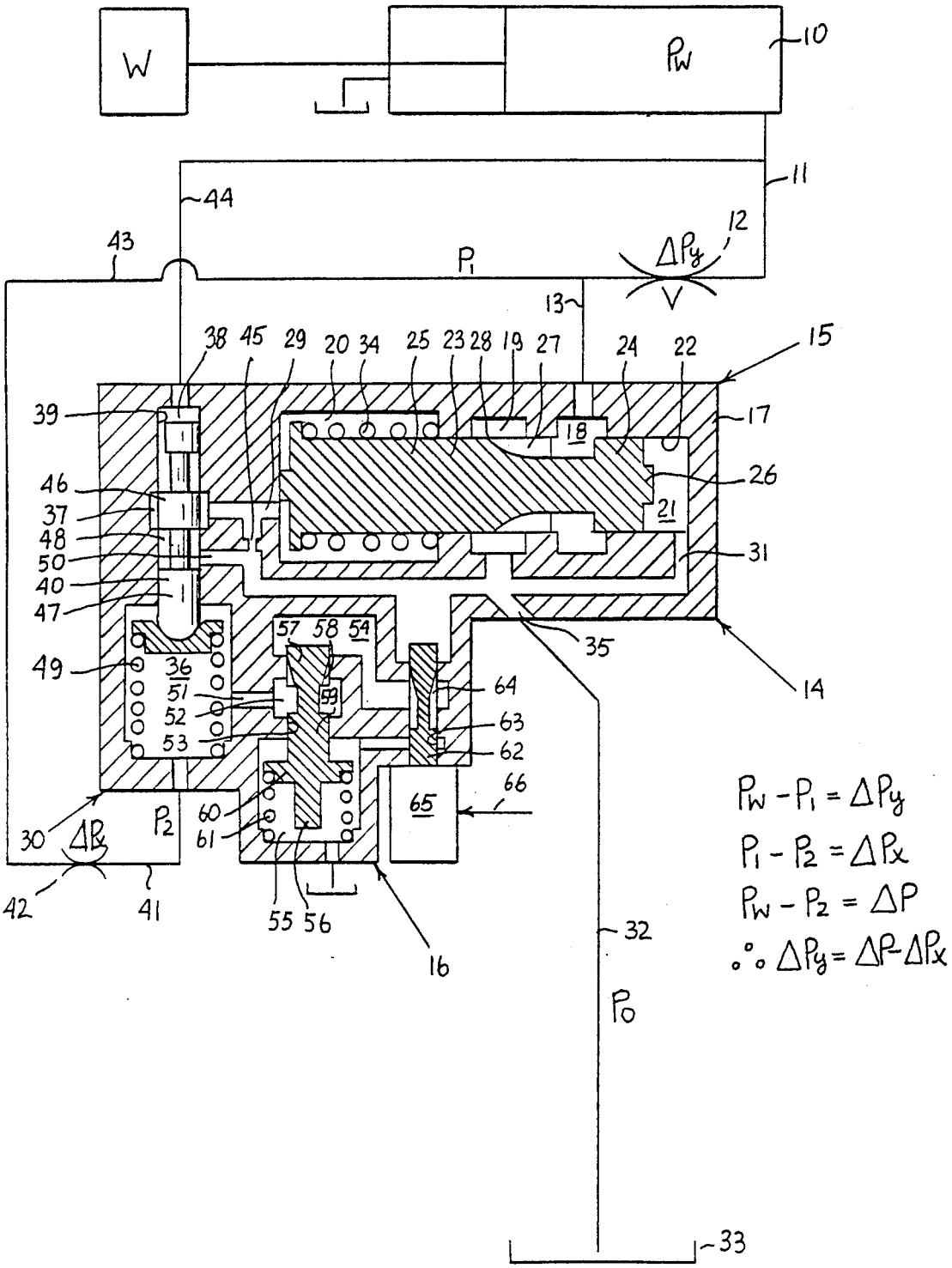
FIG. 1 is a diagrammatic representation of a load responsive pilot operated negative load pressure throttling control for adjustment in the level of control differential from a certain preselected level to zero level, with fluid motor and reservoir shown schematically.

Referring now to FIG. 1, the hydraulic system shown therein comprises a fluid motor 10 subjected to negative load pressure Wp generated by negative load W. Supply line 11 connects the fluid motor 10 through variable orifice 12 and line 13 to a differential throttling control, generally designated as 14. The differential throttling control 14, composed of throttling section, generally designated as 15 and a signal modifying section, generally designated as 16, comprises a housing 17 having an inlet chamber 18, an outlet chamber 19, a first control chamber 20 and a low pressure chamber 21, all of those chambers being connected by bore 22, slidably guiding a throttling spool 23. The throttling spool 23, equipped with lands 24 and 25 and stop 26, is provided with throttling slots 27, terminating in cut-off edges 28, between the inlet chamber 18 and the outlet chamber 19. One end of the throttling spool 23 projects into the first control chamber 20, which communicates through passage 29 with a pilot valve section, generally designated as 30. The other end of the throttling spool 23 projects into the low pressure chamber 21, which is connected through passage 31 and line 32 with system reservoir 33. A control spring 34 in the first control chamber 20 is interposed between the housing 17 and the throttling spool 23. The outlet chamber 19 of the throttling section 15 is connected through port 35 and line 32 with a system reservoir 33. The pilot valve section 30 is provided with a second control chamber 36, annular space 37 and space 38, connected by bore 39 axially guiding pilot valve spool 40. The second control chamber 36 is connected by line 41, orifice 42 and line 43 with down stream of variable orifice 12. Space 38 is connected by line 44 with upstream of variable orifice 12. Annular space 37 communicates by passage 29 with the first control chamber 20 and by leakage orifice 45, passage 31, port 35 and line 32 with the system reservoir 33. The pilot valve spool 40, equipped with metering land 46 and land 47, which define annular space 48, projects into the second control chamber 36, where it engages a spring 49. Annular space 48 is connected by passage 50 with passage 31, which in turn is connected to the system reservoir 33. The second control chamber 36 is also connected through port 51 with a supply chamber 52, connected by bore 53 with a third control chamber 54 and an exhaust chamber 55. Bore 53 slidably guides a control spool 56, equipped with land 57, provided with throttling slots 58 and positioned between the supply chamber 52 and the third control chamber 54, a land 59 separating the supply chamber 52 and the exhaust chamber 55 and flange 60. A spring 61 is interposed in the exhaust chamber 55 between the flange 60 of the control spool 56 and the housing 17. The exhaust chamber 55 and the third control chamber 54 are selectively interconnected by metering orifice created by a stem 62 guided in bore 63 and provided with metering slots 64. The stem 62 is connected to an actuator 65 responsive to external control signal 66.

Figure 2:
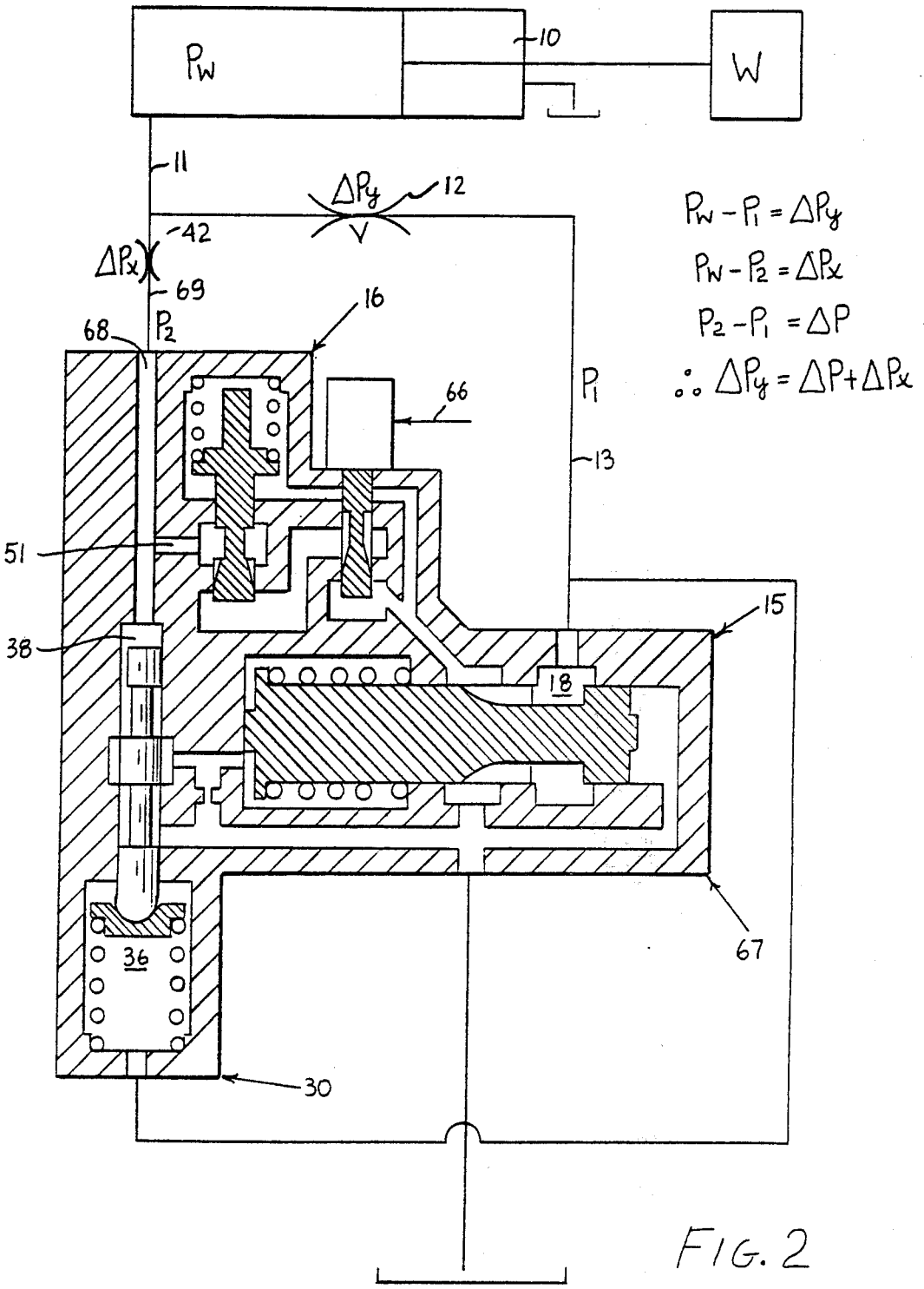
FIG. 2 is a diagrammatic representation of another embodiment of a load responsive pilot operated negative load pressure throttling control for adjustment in the level of control differential from a certain minimum preselected value up to maximum level, with fluid motor and reservoir shown schematically.

Referring now to FIG. 2, the same components used in FIG. 1 are designated by the same numerals. The only difference between the load responsive controls of FIGS. 1 and 2 is the phasing of internal components of the differential throttling control 14 of FIG. 1. A differential throttling control 67 of FIG. 2 is composed of the throttling section 15, the signal modifying section 16 and the pilot valve section 30 indentical to that of FIG. 1.

In both figures, in an identical way, the load pressure is transmitted through supply line 11, variable orifice 12 and line 13 to the inlet chamber 18 of the throttling section 15. However, the signal modifying section 16 in FIG. 1 is connected by port 51 with the second control chamber 36, which in turn is connected by line 41, orifice 42 and line 43 to down stream of variable orifice 12, while in FIG. 2 the signal modifying section 16 is connected by port 51 with space 38 which in turn is connected by passage 68 and line 69, orifice 42 and line 11 with the fluid motor 10 upstream of variable orifice 12.

Figure 3:
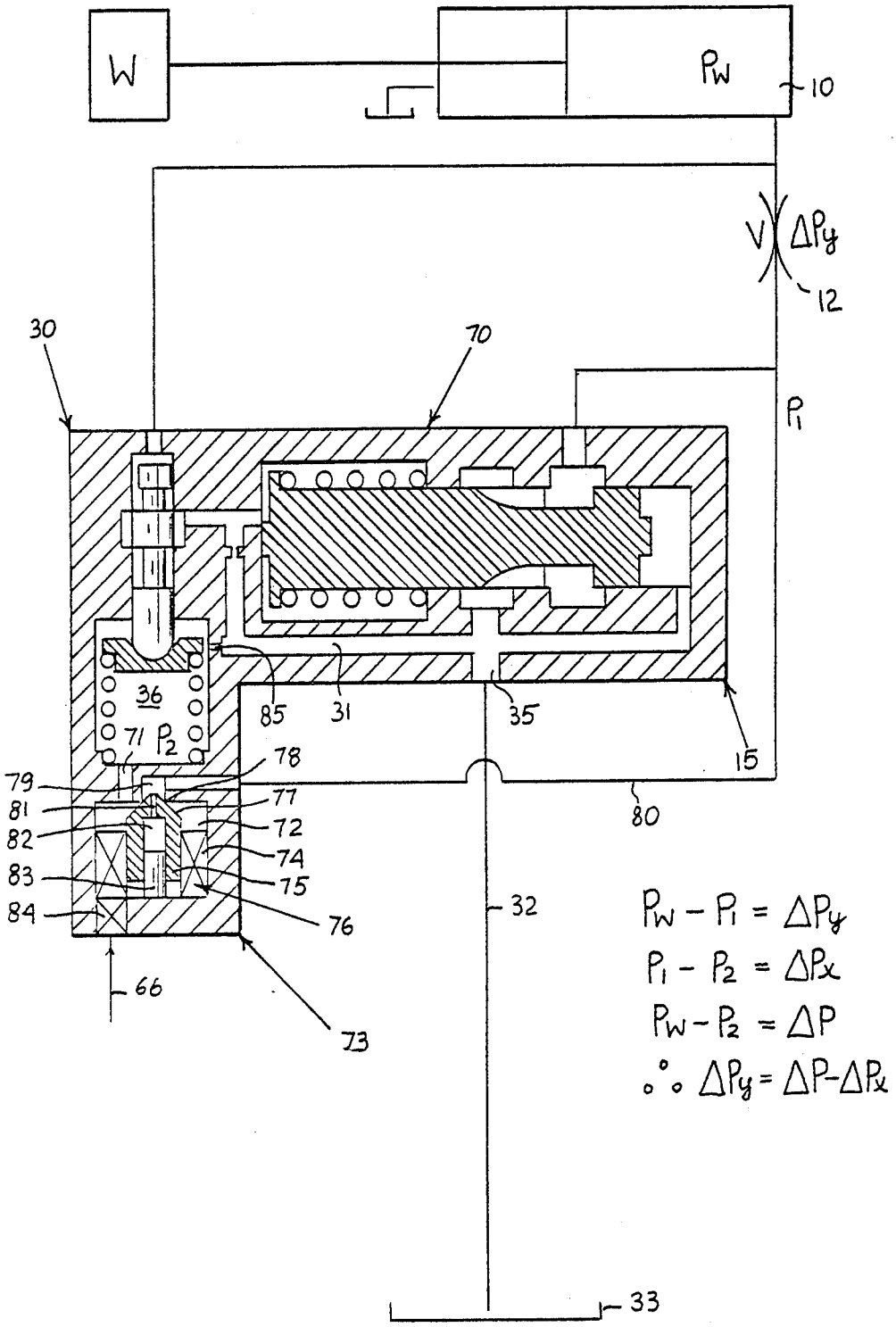
FIG. 3 is a diagrammatic representation of another embodiment of the load responsive pilot operated negative load pressure throttling control of FIG. 1, with fluid motor and reservoir shown schematically.

Referring now to FIG. 3, the same components used in FIG. 1 are designated by the same numerals. The basic load responsive circuit of FIG. 3 with some of the circuit components, including some of the internal components of differential throttling control, generally designated as 70, are the same as those of FIG. 1. The second control chamber 36 is connected by port 71 to a chamber 72 of differential valve, generally designated as 73. The differential valve 73 comprises a coil 74, retained in the housing, which guides an armature 75 of a solenoid, generally designated as 76. The armature 75 is provided with a conical surface 77, selectively engagable with sealing edge 78 of flow port 79, connected to down stream of variable orifice 12, by line 80, The armature 75 is also provided with venting passage 81 terminating in bore 82, guiding a reaction pin 83. The coil 74 is connected by sealed connector 84 to outside of the housing, external control signal being applied to the sealed connector 84. The second control chamber 36 is connected by leakage orifice 85, passage 31, port 35 and line 32 to the system reservoir 33.

Figure 4:
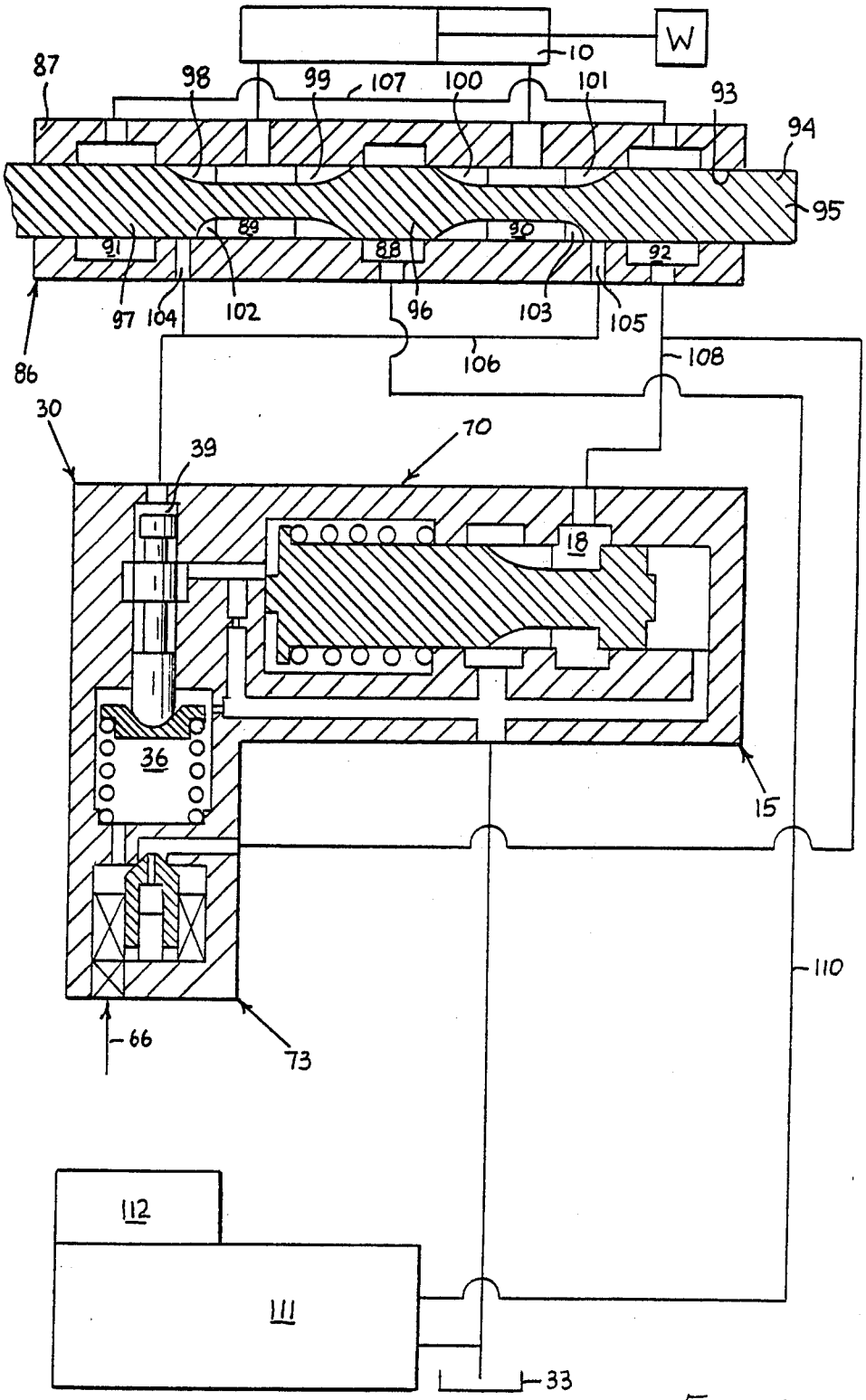
FIG. 4 is a section view through a four way load responsive direction control valve for control of negative load using the control of FIG. 3 with system pump and reservoir shown schematically.

Referring now to FIG. 4 the same components used in FIG. 3 are designated by the same numerals. The differential throttling control 70 of FIG. 3 was integrated in FIG. 4 into a four way valve assembly, generally designated as 86. The four way valve assembly, generally designated as 86, comprises a housing 87 having an inlet chamber 88, load chambers 89 and 90 and outlet chambers 91 and 92, interconnected by bore 93, guiding a valve spool 94. The valve spool 94 is provided with lands 95, 96 and 97, throttling slots 98, 99, 100 and 101 and signal slots 102 and 103. The housing 87 is also provided with load sensing ports 104 and 105 communicating through line 106 with space 39 of the pilot valve section 30. Outlet chambers 91 and 92 interconnected by line 107 communicate through line 108 with the inlet chamber 18 of the throttling section 15. The inlet chamber 88 is connected by line 110 to a system pump 111 controlled by pump control 112 and supplied with suction fluid from a reservoir 33. Load chambers 89 and 90 are connected to the fluid motor 10.

Figure 5:
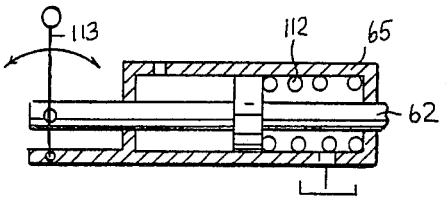
FIG. 5 is a diagrammatic representation of manual control input into the load responsive controls of FIGS. 1 to 4.

Referring now to FIG. 5, the stem 62 of the actuator 65 of FIGS. 1 to 4 is biased by a spring 112 towards position of zero orifice and is directly operated by a lever 113, which provides the external signal 66.

Figure 6:
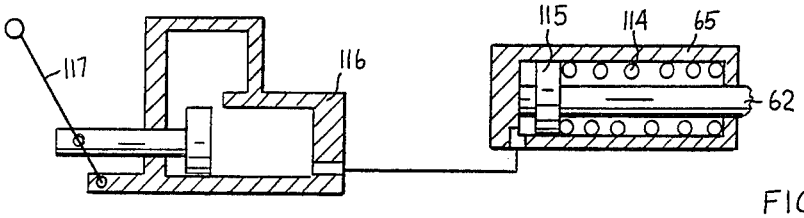
FIG. 6 is a diagrammatic representation of hydraulic control input into load responsive controls of FIGS. 1 to 4.

Referring now to FIG. 6, the stem 62 of the actuator 65 of FIGS. 1 to 4 is biased by a spring 114 towards position of zero orifice and is directly operated by a piston 115. Fluid pressure is supplied to the piston 115 from a pressure generator 116, operated by a lever 117.

Figure 7:
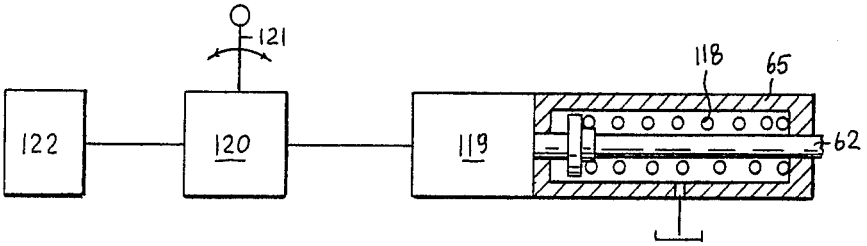
FIG. 7 is a diagrammatic representation of electrohydraulic control input into load responsive controls of FIGS. 1 to 4.

Referring now to FIG. 7, the stem 62 of the actuator 65 of FIGS. 1 to 4, is biased by a spring 118 towards position of zero orifice and is directly operated by a solenoid 119, connected by a line to an input current control 120, operated by a lever 121 and supplied from an electrical supply source 122.

Figure 8:
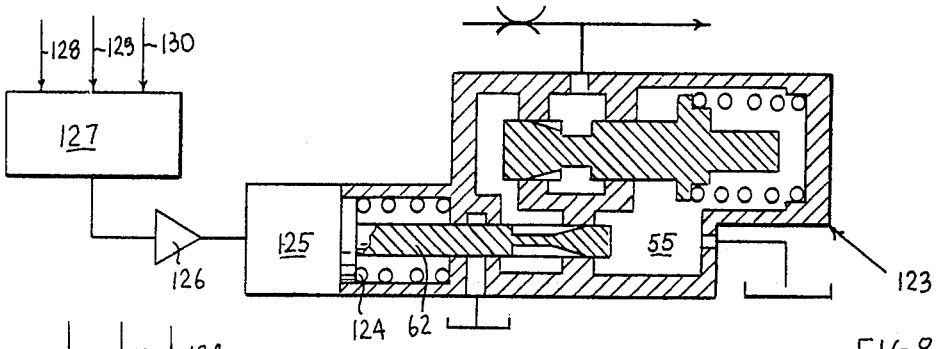
FIG. 8 is a diagramamatic representation of an electromechanical control input into load responsive controls of FIGS. 1 to 4.

Referring now to FIG. 8, the stem 62 of the differential control, generally designated as 123, is biased by a spring 124 towards a position, where it isolates the third control chamber 54 from the exhaust chamber 55 and is controlled by a solenoid 125. The electrical control signal, amplified by amplifier 126, is transmitted from a logic circuit or a micro-processor 127, subjected to inputs 128, 129 and 130.

Figure 9:
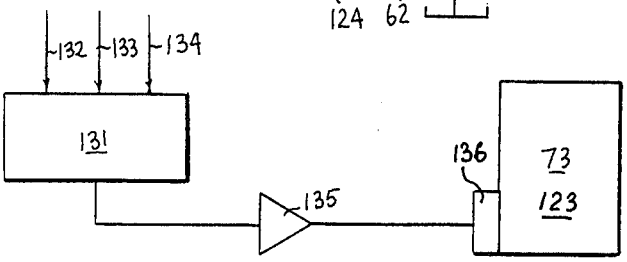
FIG. 9 is a diagrammatic representation of an electromechanical control input into load responsive system of FIG. 3.

Referring now to FIG. 9, a logic circuit or a microprocessor 131, supplied with control signals 132, 133 and 134, transmits an external digital control signal to a stepping motor 136 of the differential valve 73 or 123 of FIGS. 3 and 8 through an amplifier 135.

Referring now to FIG. 1, the differential throttling control 14 is interposed between the fluid motor 10 and the reservoir 33 and controls the fluid flow and pressure therebetween. The differential throttling control 14 is composed of the throttling section 15, the signal modifying section 16 and the pilot valve section 30. The throttling section 15 with its throttling spool 23 throttles with throttling slots 27 fluid flow from the inlet chamber 18, connected by line 13, variable orifice 12 and supply line 11 to the fluid motor 10, to the outlet chamber 19, connected by line 32 with the system reservoir 33, to automatically maintain a constant pressure differential across variable orifice 12. This control action is accomplished in the following way. Fluid from the fluid motor 10 at Pw pressure, which is the load pressure, acting upstream of variable orifice 12, is transmitted through line 44 to space 38 where, reacting on the cross-sectional area of the pilot valve spool 40, generates a force tending to move the pilot valve spool 40 downward to connect Pw pressure through annular space 37 and passage 29 to the first control chamber 20 and therefore increase the pressure level in the first control chamber 20. Fluid at load pressure $P_1$, which is the pressure acting down stream of variable orifice 12, is transmitted through line 43 and orifice 42 to the second control chamber 36 where, reacting on the cross-sectional area of the pilot valve spool 40 it generates a force tending to move the pilot valve spool upwards, to connect the reservoir pressure from annular space 48 to annular space 37, passage 29 and to the first control chamber 20 and therefore decrease the pressure level in the first control chamber 20. This force due to pressure in the second control chamber 36 is supplemented by the biasing force of the spring 49. Increase in pressure level in the first control chamber 20, above the level equivalent to preload of control spring 34, reacting on cross-sectional area of the throttling spool 23, will generate a force tending to move the throttling spool 23 from left to right, in the direction of closing of the flow area through the throttling slots 27 and therefore in direction of increasing the throttling action of the throttling spool 23. Conversely, a decrease in the level in the first control chamber 20, below the level equivalent to preload of control spring 34, will result in the control spring 34 moving the throttling spool 23 from right to left, in the direction of increasing the flow area through the throttling slots 27 and therefore in direction of decreasing the throttling action of the throttling spool 23. Therefore by regulating pressure level in the first control chamber 20 the pilot valve spool 40 will control the throttling action of the throttling spool 23 and consequently the pressure drop between the inlet chamber 18 subjected to $P_1$ pressure and the outlet chamber 19 subjected to $P_o$ pressure. Assume that the stem 62 is in the position as shown in FIG. 1, isolating the third control chamber 54 from the exhaust chamber 55 and therefore making the signal modifying section 16 inactive. The pilot valve spool 40, subjected to Pw and $P_2$ pressures and the biasing force of spring 49 will reach a modulating position, in which by throttling action of metering land 46 will regulate the pressure in the first control chamber 20 and therefore the throttling action of the throttling spool 23 to throttle the load pressure Pw to a level of $P_1$ pressure, Pw being higher, by a constant pressure differential $\Delta P$, than $P_2$ pressure and equal to the quotient of the biasing force of spring 49 and the cross-sectional area of the pilot valve spool 40. In this way the pilot valve spool 40, subjected to low energy pressure signals, will act as an amplifying stage using the energy derived from the fluid motor 10 to control the position and therefore the throttling action of the throttling spool 23. Leakage orifice 45, connecting the first control chamber 20 through passage 31 and line 32 to the reservoir 33, is used, in a well known manner, to increase the stability of the pilot valve spool 40. If $P_2$ pressure is equal to $P_1$ pressure, which is the case when the stem 62 is in the position, as shown in FIG. 1, the throttling section 15, by throttling fluid flow from the inlet chamber 18 to the outlet chamber 19, will automatically maintain a constant pressure differential $\Delta P$ between space 38 and the second control chamber 36 and with $\Delta Py$ becoming $\Delta P$, will also maintain a constant pressure differential across variable orifice 12. With constant pressure differential, acting across an orifice, the flow through an orifice will be proportional to the area of the orifice and independent of pressure in the fluid motor. Therefore by varying the area of variable orifice 12, the fluid flow from the fluid motor 10 and velocity of the load W can be controlled, each specific area of variable orifice 12 corresponding to a specific velocity of load W, which will remain constant, irrespective of the variation in the magnitude of the load W.

In the arrangement of FIG. 1 the relationship between $P_1$ pressure down stream of variable orifice 12 and signal pressure $P_2$ is controlled by the signal modifying section, generally designated as 16, and orifice 42. Assume that the stem 62, positioned by the actuator 65 in response to external control signal 66, as shown in FIG. 1, blocks completely metering orifice through metering slots 64, isolating the third control chamber 54 from the exhaust chamber 55. The control spool 56 with its land 57, protruding into the third control chamber 54, will generate pressure in the third control chamber 54, equivalent to the preload of the spring 61. Displacement of the stem 62 upwards will move metering slots 64 out of bore 63, creating an orifice area, through which fluid flow will take place from the third control chamber 54 to the system exhaust. The control spool 56, biased by the spring 61, will move upward connecting by throttling slots 58 the supply chamber 52 with the third control chamber 54. Rising pressure in the third control chamber 54, reacting on cross-sectional area of the control spool 56, will move it back into a modulating position, in which sufficient flow of pressure fluid will be throttled from the supply chamber 52 to the third control chamber 54, to maintain the third control chamber 54 at a constant pressure, equivalent to preload in the spring 61. When displacing metering slots 64, in respect to bore 63, area of metering orifice between the third control chamber 54 and the system exhaust will be varied. Since constant pressure differential is automatically maintained between the system exhaust and the third control chamber 54 and therefore across the metering slots 64, by the control spool 56, each specific area of metering slots 64 will correspond to a specific constant flow level from the third control chamber 54 to the system exhaust and from the supply chamber 52 to the third control chamber 54, irrespective of the magnitude of the pressure in the supply chamber 52. Therefore, each specific position of stem 62, within the zone of metering slots 64, will correspond to a specific flow level and therefore a specific pressure drop $\Delta Px$ through the fixed orifice 42, irrespective of the magnitude of the load pressure Pw. When referring to FIG. 1 it can be seen that $Pw-P_1=\Delta Py$, $Pw-P_2=\Delta P$, maintained constant by the throttling section 16 and $P_1-P_2=\Delta Px$. From the above equations, when substituting and eliminating $P_1$, $P_2$ and Pw a basic relationship of $\Delta Py=\Delta P-\Delta Px$ is obtained. Since $\Delta Px$ can be varied and maintained constant at any level by the signal modifying section 16, so can $\Delta Py$, acting across variable orifice 12, be varied and maintained constant at any level. Therefore with any specific constant area of variable orifice 12, in response to control signal 66, pressure differential $\Delta Py$ can be varied from maximum to zero, each specific level of $\Delta Py$ being automatically controlled constant, irrespective of variation in the load pressure Pw. Therefore, for each specific area of variable orifice 12 the pressure differential, acting across orifice 12 and the flow through orifice 12 can be controlled from maximum to minimum by the signal modifying section 16, each flow level automatically being controlled constant by the differential throttling control 14, irrespective of the variation in the load pressure Pw. From inspection of the basic equation $\Delta Py=\Delta P-\Delta Px$ it becomes apparent that with $\Delta Px=0$, $\Delta Py=\Delta P$ and that the system will revert to the mode of operation of conventional load responsive system, with maximum constant $\Delta P$ of the differential throttling control 14. When $\Delta Px=\Delta P$, $\Delta Py$ becomes zero, inlet pressure to the throttling section 15 $P_1$ will be equal to load pressure Pw and the flow through variable orifice 12 will become zero.

In the load responsive system of FIG. 1 for each specific value of $\Delta Py$, maintained constant by the signal modifying section 16 through the throttling section 15 of the differential control 14, the area of variable orifice 12 can be varied, each area corresponding to a specific constant flow from the fluid motor 10, irrespective of the variation in the magnitude in the load pressure Pw. Conversely, for each specific area of the variable orifice 12 pressure differential $\Delta Py$, acting across orifice 12, can be varied by the signal modifying section 16, through the throttling section 15 of the differential throttling control 14, each specific pressure differential $\Delta Py$ corresponding to a specific constant flow from the fluid motor 10 irrespective of the variation in the magnitude of the load pressure Pw. Therefore fluid flow from fluid motor 10 can be controlled either by variation in area of variable orifice 12, or by variation in pressure differential $\Delta Py$, each of those control methods displaying identical control characteristics and controlling flow, which is independent of the magnitude of the load pressure. Action of one control can be superimposed on the action of the other, providing a unique system, in which, for example, a command signal from the operator, through the use of variable orifice 12 can be corrected by signal 66 from a computing device, acting through the signal modifying section 16.

Referring now to FIG. 2, the signal modifying section 16 is, identical to the signal modifying section 16 of FIG. 1 and performs in an identical way, by modifying a control signal transmitted to the throttling section 15. The throttling section 15 and the pilot valve section 30 of FIG. 2 are identical to the throttling section 15 and the pilot valve section 30 of FIG. 1. However, the signal modifying section 16 of FIG. 2 modifies the control signal from the fluid motor 10 and therefore from upstream of the variable orifice 12, instead of modifying the control signal of $P_2$ pressure, as shown in the system of FIG. 1. Therefore, as can be seen in FIG. 2, $Pw-P_1=\Delta Py$, $Pw-P_2=\Delta Px$ and $P_2-P_1=\Delta P$, which, in a manner as previously described, is the basic system differential and is maintained constant by the throttling section 15 of the differential throttling control 67. From the above equations, when substituting and eliminating $P_1$, $P_2$ and Pw the basic relationship of $\Delta Py=\Delta P+\Delta Px$ can be obtained. Since $\Delta Px$ can be varied and maintained constant at any level, so can $\Delta Py$, acting across variable orifice 12 be varied and maintained constant at any level. From inspection of the basic equation $\Delta Py=\Delta P+\Delta Px$ it becomes apparent that with $\Delta Px=O$, $\Delta Py=\Delta P$ and that the system will revert to the mode of operation of conventional load responsive system, with minimum constant $\Delta P$ equal to pressure differential of the throttling section 15. Any value of $\Delta Px$, other than zero will increase the pressure differential $\Delta Py$, acting across variable orifice 12 above the level of constant pressure differential $\Delta P$ of the throttling section 15. Therefore, the load responsive control arrangement of FIG. 1 will control $\Delta Py$ in a range between $\Delta P$ and zero, while the load responsive arrangement of FIG. 2 will control $\Delta Py$ in a range above the level of constant pressure differential $\Delta P$ of the throttling section 15.

Referring now to FIG. 3, the load responsive system is similar to that of FIG. 1. The throttling section 15 of the differential throttling control 70 together with the pilot valve section 30 of FIG. 3, are identical to that of FIG. 1. However, the differential valve 73 is different from the signal modifying section 16 of FIG. 1, although it performs the same function and provides identical performance. The differential valve, generally designated as 73, contains the solenoid, generally designated as 76, which consists of coil 74, secured in the housing and the armature 75, slidably guided in the coil 74. The armature 75 is provided with conical surface 77, which, in cooperation with sealing edge 78, regulates the pressure differential ΔPx between flow port 79 and the chamber 72. The sealed connector 84, in the housing, well known in the art, connects the coil 74 with external terminals, to which the external signal 66 can be applied. A solenoid is an electro-mechanical device, using the principle of electro-magnetics, to produce output forces from electrical input signals. The force developed on the solenoid armature 75 is a function of the input current. As the current is applied to the coil 74, each specific current level will correspond to a specific force level, transmitted to the armature. Therefore, the contact force between the conical surface 77 of the armature 75 and sealing edge 78 of the housing will vary and be controlled by the input current. This arrangement will then be equivalent to a type of differential pressure throttling valve varying automatically the pressure differential ΔPx between flow port 79 and the second control chamber 36, in proportion to the force developed in the armature 75, in respect to the area enclosed by the sealing edge 78 and therefore proportional to the external signal 66, of the input current supplied to the solenoid 76. The pressure forces acting on the armature 75, within the housing, are completely balanced with the exception of the pressure force due to the pressure differential ΔPx acting on the enclosed area of sealing edge 78. This force is partially balanced by the reaction force, developed on the cross-sectional area of the reaction pin 83, guided in a bore 82, which is connected through venting passage 81 with flow port 79. The cross-sectional area of the reaction pin 83 must always be smaller than the area enclosed by sealing edge 78, so that a positive force, due to the pressure differential ΔPx, opposes the force developed by the solenoid 76. The reaction pin 83 permits use of a larger flow port 79, while also permitting a very significant reduction in the solenoid 76, also permitting the solenoid 76 to work in the higher range of ΔPx. The second control chamber 36 may be connected by conventional flow control valve with the system reservoir instead of by leakage orifice 85. Simple leakage orifice 85 is shown in FIG. 3 connecting the second control chamber 36 and passage 31.

Referring now to FIG. 4, the load responsive system is identical to that as shown in FIG. 3 with identical differential throttling controls being used, but the variable orifice 12 of FIG. 1 was substituted in FIG. 4 by a load responsive four way type direction control valve, generally designated as 86. The performance of the control embodiment of FIGS. 3 and 4 is identical, the only difference being the construction of the variable orifice. The differential throttling control and specifically space 39 is connected with the load sensing ports 104 and 105 of the four way valve 86. The second control chamber 36 is connected through the differential valve 73 with the outlet chambers 91 and 92. With the valve spool 94 in its neutral position, as shown in FIG. 4, load pressure sensing ports 104 and 105 are blocked by the lands 97 and 95 therefore effectively isolated from load pressure, existing in load chamber 89 or 90. Displacement of the valve spool 94 from its neutral position in either direction, first connects with signal slot 102 or 103 load chamber 89 or 90 with load pressure sensing port 104 or 105, while load chambers 89 and 90 are still isolated by the valve spool 94 from the inlet chamber 88 and outlet chambers 91 and 92. Then the load pressure signal is transmitted through load pressure sensing port 104 or 105 and line 106 to space 39, permitting the differential throttling control 70 to react, before metering orifice is open to the load chamber 89 or 90. Further displacement of valve spool 94, in either direction, will create, in a well known manner, through metering slot 98 or 101 a metering orifice between one of the load chambers and the outlet chamber 91 or 92, while connecting the other load chamber, through metering slot 99 or 100 with the inlet chamber 88. The metering orifice can be varied by displacement of valve spool 94, each position corresponding to a specific flow level out of one of the load chambers, irrespective of the magnitude of the load controlled by four way valve assembly 86. Upon this control, in a manner as previously described when referring to FIG. 1, can be superimposed the control action of differential valve 73. With valve spool 94 displaced to any specific position, corresponding to any specific area of metering orifice, the flow out of load chambers can be proportionally controlled by the differential throttling control 70 with its differential valve 73, each value of pressure differential ΔPy being automatically maintained at a constant level by the throttling section 15 and corresponding to a specific flow level out of one of the load chambers, irrespective of the magnitude of the load controlled by the four way valve assembly 86.

Referring now to FIG. 5, the stem 62 of the actuator 65 of FIGS. 1 and 2 is biased by spring 112 towards position of zero orifice and is directly operated by a lever 113, which provides the external signal in the form of manual input.

Referring now to FIG. 6, the stem 62 of actuator 65 of FIGS. 1 and 2 is biased by spring 114 towards position of zero orifice and is directly operated by a piston 115. Fluid pressure is supplied, in a well known manner, to the piston 115 from a pressure generator 116, operated by a lever 117. Therefore the arrangement of FIG. 6 provides the external signal 66 in the form of a fluid pressure signal.

Referring now to FIG. 7, the stem 62 of the actuator 65 of FIGS. 1 to 4 is biased by a spring 118 towards position of zero orifice and is directly operated, in a well known manner, by a solenoid 119, connected by a line to an input current control 120, operated by a lever 121 and supplied from an electrical power source 122. Therefore the arrangement of FIG. 7 supplies the external signal 66 in the form of an electric current, proportional to displacement of lever 121.

Referring now to FIG. 8, the stem 65 of the differential control 123 is biased by a spring 124 towards a position, where it isolates the third control chamber 54 from the exhaust chamber 55. The stem 62 is completely pressure balanced, can be made to operate through a very small stroke and controls such low flows, at such low pressures, that the influence of the flow forces is negligible. The stem 62 is directly coupled to a solenoid 125. The position of solenoid armature, when biased by a spring, is a function of the input current. For each specific current level there is a corresponding particular position, which the solenoid will attain. As the current is varied from zero to maximum rating, the armature will move one way from a fully retracted to a fully extended position in a predictable fashion, depending on the specific level of current at any one instant. Since the forces, developed by solenoid 125 are very small, so is the input current, which is controlled by a logic circuit or a micro-processor 127. The micro-processor 127 will then, in response to different types of transducers either directly control the system load, in respect to speed, force and position, or can superimpose its action upon the control function of an operator, to perform required work in the minimum time, with a minimum amount of energy, within the maximum capability of the structure of the machine and within the envelope of its horsepower.

Referring now to FIG. 9, the control signal from the logic circuit, or the micro-processor 131, which may be of a digital or analog type, is transmitted through an actuator and positions the stem 62 of the differential valve 123 of FIG. 8. If the control signal from the micro-processor 131 is of a digital type the actuator will most likely be the stepping motor 136, provided with a lead screw, well known in the art, which will directly position the stem 62 in response to a digital control signal, dispensing with the need for a digital to analog convertor. This approach applies equally well to the arrangement of FIG. 3 where the signal 66 can be supplied from a stepping motor which would increase in steps the current supplied to the coil of the solenoid using any of the conventional devices, well known in the art.

As previously described the stem 62 is completely balanced from the force standpoint and requires minimal power levels for its actuation. Therefore with the digital control signal a low power stepping motor with a lead screw can provide simple reliable and inexpensive interface hardware between the valve controls and the electronic circuit.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having an inlet chamber connected to a fluid motor, and an exhaust chamber connected to exhaust means, control orifice means interposed between said inlet chamber and said fluid motor, first valve means having fluid throttling means between said inlet chamber and said exhaust chamber controllable by a pilot valve means and operable to throttle fluid flow from said inlet chamber to said exhaust chamber to maintain a constant pressure differential at a preselected constant level across said pilot valve means and to maintain a constant pressure differential across said control orifice means, and second valve means having means operable through said first valve means to vary the level of said constant pressure differential across said control orifice means while said pressure differential across said pilot valve means remains constant at said constant predetermined level.

2. A valve assembly as set forth in claim 1 wherein said control orifice means has variable area orifice means.

3. A valve assembly as set forth in claim 1 wherein said second valve means has means to vary the level of said constant pressure differential across said control orifice means above the level of said pressure differential across said pilot valve means maintained constant at said constant predetermined level.

4. A valve assembly as set forth in claim 1 wherein said second valve means includes constant pressure reducing means, orifice means upstream of said constant pressure reducing means, and flow orifice means down stream of said constant pressure reducing means.

5. A valve assembly as set forth in claim 1 wherein said second valve means includes fluid throttling means and orifice means down stream of said fluid throttling means communicable with said exhaust means.

6. A valve assembly as set forth in claim 1 wherein said second valve means has means to vary the level of said constant pressure differential across said control orifice means below the level of said pressure differential across said pilot valve means maintained constant at said constant predetermined level.

7. A valve assembly as set forth in claim 1 wherein said second valve means has means responsive to an external control signal.

8. A valve assembly as set forth in claim 7 wherein said means responsive to an external control signal includes mechanical actuating means.

9. A valve assembly as set forth in claim 7 wherein said means responsive to an external control signal includes fluid pressure actuating means.

10. A valve assembly as set forth in claim 7 wherein said means responsive to an external control signal includes electro-hydraulic actuating means.

11. A valve assembly as set forth in claim 7 wherein said means responsive to an external control signal includes electro-mechanical actuating means.

12. A valve assembly comprising a housing having an inlet chamber connected to a fluid motor, and an exhaust chamber connected to exhaust means, control orifice means interposed between said fluid motor and said inlet chamber, first and second control chambers in said housing, first valve means having fluid throttling means between said inlet chamber and said exhaust chamber responsive to pressure in said first control chamber, and pilot valve means operable to control pressure in said first control chamber having means responsive to pressure in said second control chamber and to pressure in said fluid motor, said first valve means operable to throttle fluid flow from said inlet chamber to said exhaust chamber to maintain a constant pressure differential at a preselected constant level between said fluid motor and said second control chamber and across said pilot valve means and to maintain a constant pressure differential across said control orifice means, pressure signal transmitting means operable to transmit control pressure signal from down stream of said control orifice means to said second control chamber, and modifying means of said control pressure signal operable through said first valve means to vary the level of said constant pressure differential controlled across said control orifice means while said pressure differential across said pilot valve means remains constant at said constant predetermined level.

13. A valve assembly as set forth in claim 12 wherein said modifying means of said control pressure signal has means to vary the level of said constant pressure differential across said control orifice means below the level of said pressure differential between said fluid motor and said second control chamber maintained constant at said constant predetermined level.

14. A valve assembly as set forth in claim 12 wherein said modifying means of said control pressure signal includes constant pressure reducing means, orifice means upstream of said constant pressure reducing means, and flow orifice means down stream of said constant pressure reducing means.

15. A valve assembly as set forth in claim 12 wherein said modifying means of said control pressure signal includes fluid throttling means and orifice means down stream of said fluid throttling means communicable with said exhaust means.

16. A valve assembly as set forth in claim 12 wherein said modifying means of said control pressure signal has means responsive to an external control signal.

17. A valve assembly comprising a housing having an inlet chamber connected to a fluid motor, and an exhaust chamber connected to exhaust means, control orifice means interposed between said fluid motor and said inlet chamber, first, second and third control chambers in said housing, first valve means having fluid throttling means between said inlet chamber and said exhaust chamber responsive to pressure in said first control chamber and pilot valve means operable to control pressure in said first control chamber having means responsive to pressure in said second control chamber and to pressure in said third control chamber, said first valve means operable to throttle fluid flow from said inlet chamber to said exhaust chamber to maintain a constant pressure differential at a preselected constant level between said third control chamber and said second control chamber and across said pilot valve means and to maintain a constant pressure differential across said control orifice means, passage means interconnecting said second control chamber and said inlet chamber, pressure signal transmitting means operable to transmit control pressure signal from said fluid motor to said third control chamber, and modifying means of said control pressure signal operable through said first valve means to vary the level of said constant pressure differential controlled across said control orifice means while said pressure differential across said pilot valve means remains constant at said constant predetermined level.

18. A valve assembly as set forth in claim 17 wherein said modifying means of said control pressure signal has means to vary the level of said constant pressure differential across said control orifice means above the level of said pressure differential between said third and said second control chambers maintained constant at said constant predetermined level.

19. A valve assembly as set forth in claim 17 wherein said modifying means of said control pressure signal includes constant pressure reducing means, orifice means upstream of said constant pressure reducing means, and flow orifice means down stream of said constant pressure reducing means.

20. A valve assembly as set forth in claim 17 wherein said modifying means of said control pressure signal includes fluid throttling means and orifice means down stream of said fluid throttling means communicable with said exhaust means.

21. A valve assembly as set forth in claim 17 wherein said modifying means of said control pressure signal has means responsive to an external control signal.

22. A valve assembly comprising a housing having a fluid inlet chamber connected to a pump, at least one load chamber, a fluid exhaust chamber, and exhaust means, first valve means for selectively interconnecting said load chamber with said inlet chamber and said exhaust chamber, variable orifice means between said load chamber and said exhaust chamber operable by said first valve means, load pressure sensing means selectively communicable with said load chamber by said first valve means, first and second control chambers in said housing, second valve means having fluid throttling means between said exhaust chamber and said exhaust means responsive to pressure in said first control chamber and pilot valve means operable to control pressure in said first control chamber having means responsive to pressure in said second control chamber and means responsive to pressure in said load pressure sensing means, said first valve means operable to throttle fluid flow from said exhaust chamber to said exhaust means to maintain a constant pressure differential at a preselected constant level between said load chamber and said second control chamber and across said pilot valve means and to maintain a constant pressure differential across said variable orifice means, pressure signal transmitting means operable to transmit control pressure signal from said exhaust chamber to said second control chamber, and modifying means of said control pressure signal operable through said second valve means to vary the level of said constant pressure differential controlled across said variable orifice means, while said pressure differential between said load chamber and said second control chamber and across said pilot valve means remains constant at said constant predetermined level.

23. A valve assembly as set forth in claim 22 wherein said first valve means has a neutral position in which it blocks said load pressure sensing means, said first valve means when displaced from said neutral position first connecting said load pressure sensing means with said load chamber before connecting said load chamber with said exhaust chamber.

24. A valve assembly comprising a housing having a load chamber connected to a fluid motor, an exhaust chamber connected to exhaust means, and load pressure sensing port means, first valve means for selectively interconnecting said load chamber with said exhaust chamber and said load sensing port means, said first valve means having a variable orifice means between said load chamber and said exhaust chamber, second valve means communicable with said load pressure sensing port means having fluid throttling means between said exhaust chamber and said exhaust means controllable by a pilot valve means and operable to throttle fluid flow from said exhaust chamber to said exhaust means to maintain a constant pressure differential at a preselected constant level across said pilot valve means and to maintain a constant pressure differential across said variable orifice means, and third valve means having means operable through said second valve means to vary the level of said constant pressure differential across said variable orifice means while said pressure differential across said pilot valve means remains constant at said constant predetermined level.

25. A valve assembly as set forth in claim 24 wherein said third valve means has means responsive to an external control signal.

26. A valve assembly as set forth in claim 25 wherein said means responsive to an external control signal includes mechanical actuating means.

27. A valve assembly as set forth in claim 25 wherein said means responsive to an external control signal includes fluid pressure actuating means.

28. A valve assembly as set forth in claim 25 wherein said means responsive to an external control signal includes electro-hydraulic actuating means.

29. A valve assembly as set forth in claim 25 wherein said means responsive to an external control signal includes electro-mechanical actuating means.

30. A load responsive valve assembly comprising a housing having an inlet chamber connected to a fluid motor, and an exhaust chamber connected to exhaust means, control orifice means interposed between said inlet chamber and said fluid motor, first valve means having fluid throttling means between said inlet chamber and said exhaust chamber controllable by a pilot valve means and operable to throttle fluid flow from said inlet chamber to said exhaust chamber to maintain a constant pressure differential at a preselected constant level across said pilot valve means and to maintain a constant pressure differential across said control orifice means.

31. A load responsive valve assembly as set forth in claim 30 wherein said pilot valve means has means responsive to pressure in said fluid motor.

32. A load responsive valve assembly as set forth in claim 30 wherein said control orifice means has variable area orifice means.

33. A load responsive valve assembly comprising a housing having an inlet chamber connected to a fluid motor, and an exhaust chamber connected to exhaust means, control orifice means interposed between said inlet chamber and said fluid motor, first and second control chambers in said housing, first valve means having fluid throttling means between said inlet chamber and said exhaust chamber provided with means responsive to pressure in said first control chamber, and pilot valve means operable to control pressure in said first control chamber having means responsive to pressure in said second control chamber and to pressure in said fluid motor, said first valve means operable to throttle fluid flow from said inlet chamber to said exhaust chamber to maintain a constant pressure differential at a preselected constant level between said fluid motor and said second control chamber and across said pilot valve means and to maintain a constant pressure differential across said control orifice means.

34. A load responsive valve assembly as set forth in claim 33 wherein said second control chamber is connected with pressure conducting means with down stream of said control orifice means.

35. A load responsive valve assembly as set forth in claim 33 wherein said fluid throttling means has spring biasing means opposing the force developed by said means responsive to pressure in said first control chamber.

36. A load responsive valve assembly comprising a housing having an inlet chamber connected to a fluid motor, and an exhaust chamber connected to exhaust means, control orifice means interposed between said fluid motor and said inlet chamber, first, second and third control chambers in said housing, first valve means having fluid throttling means between said inlet chamber and said exhaust chamber provided with means responsive to pressure in said first control chamber, and pilot valve means operable to control pressure in said first control chamber having means responsive to pressure in said second control chamber and said third control chamber, said first valve means operable to throttle fluid flow from said inlet chamber to said exhaust chamber to maintain a constant pressure differential at a preselected constant level between said third and said second control chambers and across said pilot valve means and to maintain a constant pressure differential across said control orifice means.

37. A load responsive valve assembly as set forth in claim 36 wherein said second control chamber is connected by first pressure conducting means with upstream of said control orifice means.

38. A load responsive valve assembly as set forth in claim 36 wherein said third control chamber is connected by second pressure conducting means with down stream of said control orifice means.

39. A load responsive valve assembly as set forth in claim 36 wherein said fluid throttling means has spring biasing means opposing the force developed by said means responsive to pressure in said first control chamber.

40. A load responsive valve assembly comprising a housing having a fluid inlet chamber, at least one load chamber, and an exhaust chamber, first valve means for selectively interconnecting said load chamber with said inlet chamber and said exhaust chamber, variable orifice means between said load chamber and said exhaust chamber operable by said first valve means, load pressure sensing means selectively communicable with said load chamber by said first valve means, and fluid throttling means interposed between said exhaust chamber and exhaust means, control signal transmitting means having means to transmit a first pressure signal from said exhaust chamber and means to transmit a second pressure signal from said load pressure sensing means, control means of said fluid throttling means having pilot valve means communicable with said first and said second pressure signals and operable through said fluid throttling means to throttle fluid flow from said exhaust chamber to said exhaust means to maintain a relatively constant pressure differential at a constant predetermined level across said pilot valve means and to maintain a constant pressure differential across said variable orifice means.

41. A load responsive valve assembly as set forth in claim 40 wherein said first valve means has a neutral position and isolating means operable to isolate in said neutral position said load pressure sensing means from said load chamber.

42. A load responsive valve assembly comprising a housing having a fluid inlet chamber connected to a pump, a load chamber connected to a fluid motor, an exhaust chamber, and load pressure sensing port means, first valve means for selectively interconnecting said load chamber with said inlet chamber, exhaust means and said load pressure sensing port means, said first valve means having a variable orifice means between said load chamber and said exhaust chamber, second valve means communicable with said load pressure sensing port means having fluid throttling means between said exhaust chamber and said exhaust means controllable by a pilot valve means and operable to throttle fluid flow from said fluid motor to said exhaust means to maintain a constant pressure differential at a preselected constant level across said pilot valve means and to maintain a constant pressure differential across said variable orifice means.

43. A load responsive valve assembly as set forth in claim 42 wherein said pilot valve means has first means responsive to pressure upstream of said variable orifice means and second means responsive to pressure down stream of said variable orifice means.

* * * * *